United States Patent [19]

Drake

[11] 4,011,722

[45] Mar. 15, 1977

[54] VARIABLE DISPLACEMENT HYDRAULIC PUMP APPARATUS

[76] Inventor: J. Howard Drake, 2619 Lindentree Lane, Santa Clara, Calif. 95051

[22] Filed: May 10, 1976

[21] Appl. No.: 684,638

[52] U.S. Cl. ..... 60/465; 60/487; 60/490; 417/359

[51] Int. Cl.[2] ..... F15B 15/18; F16H 39/46

[58] Field of Search ..... 60/465, 476, 487, 489, 60/490; 417/359

[56] References Cited

UNITED STATES PATENTS

| | | | |
|---|---|---|---|
| 1,571,954 | 2/1926 | Lambert | 60/490 X |
| 2,420,806 | 5/1947 | Anderson | 60/487 X |
| 2,685,255 | 8/1954 | Carner | 60/490 X |
| 3,044,409 | 7/1962 | Harris | 60/487 X |

*Primary Examiner*—Edgar W. Geoghegan
*Attorney, Agent, or Firm*—Boone, Schatzel, Hamrick & Knudsen

[57] ABSTRACT

A hydraulic pump apparatus including an outer housing having internal walls which are spherically configured, a hydraulically actuable variable position control ring which cooperates with the spherical housing walls to define the geometry of a hydraulic working cavity, and a rotor assembly having vanes which divide the working cavity into a plurality of working chambers and which follow the position of the control ring to vary the volume of the working chambers so as to move fluid into and out of inlet and outlet ports, respectively. The vanes are supported by a plurality of concentric rings which are attached in gimbal fashion to a rotor hub and pin assembly.

12 Claims, 12 Drawing Figures

VARIABLE DISPLACEMENT HYDRAULIC PUMP APPARATUS

BACKGROUND OF THE INVENTION

1. Field of the Invention

The present invention relates generally to hydraulic pump devices and more specifically to a variable displacement hydraulic pumping mechanism that can be operated in both driving and driven configurations and has particular application in mechanical power transmission apparatus.

2. Description of the Prior Art

The hydraulic variable displacement pump device has two principal applications, the transmission of rotary mechanical power and the pumping of fluids. As a transmission, it can accomplish torque multiplication to increase or decrease output torque relative to input torque; speed multiplication to increase or decrease output speed relative to input speed; reversal of direction of rotation (i.e., from clockwise to counterclockwise or vice versa); connection or disconnection of input power from output load as in a conventional clutching mechanism; braking of the output shaft by causing the load to drive the input motor against a drag; and locking of either the input or output shaft so that it cannot rotate. In addition, it can be used as a rotational angular positioning servo to place an output shaft at a prescribed angular position and to hold or maintain the position of a driven body as a function of time as, for example, a gun turret or antenna pointing mechanism. Moreover, it can be used to transfer any of the above functions to a point remote from the power source, and it can be used to drive two or more loads independently.

When used as a pump the variable displacement device can cause a fluid to be transported from one place to another or to have its pressure or velocity of flow increased; supply a prescribed quantity of fluid or rate of flow. Since the pump is of the positive displacement type such that at fixed displacement the quantity of fluid delivered is directly proportional to the number of shaft rotations and the rate of flow is proportional to the rotational speed of the shaft (If the pump is driven by the flow fron another source, it also can function as a flow meter to measure the quantity or rate of flow delivered by the source); supply a variable rate and direction of flow while input speed is fixed (by using variable and reversible displacement); and when operated at constant input torque and variable displacement, it can provide a variable output pressure.

Although clutches, fluid couplings, torque converters, gear trains, and automatic transmissions perform some of the above-mentioned functions, the only devices known which can perform all of the functions listed above are positive, variable displacement hydraulic drives.

Prior art devices of this type are disclosed in the U.S. Pat. Nos. to Sherman, 2,401,376; Pichon, 3,832,198; Van Cleve, 2,962,864; Harris, 3,095,708; Parr, 3,487,787; Briggs, 3,570,246; and Bennetto, 3,730,145. However, such devices suffer substantial disadvantages ranging from mechanical complexity and manufacturing impracticality to extreme operational inefficiency.

SUMMARY OF THE PRESENT INVENTION

It is therefore an object of the present invention to provide a hydraulic turbine apparatus which is relatively simple in construction, versatile in application, and highly efficient in use. As used herein, the term "hydraulic turbine" is intended to be a generic descriptor referring to the present invention when used as either a fluid driving pump or a fluid driven motor.

Briefly, the presently preferred embodiment of the present invention includes an outer housing having internal walls which are spherically configured, a hydraulically actuable control ring which cooperates with the spherical housing walls to define the geometry of a hydraulic working cavity, and a rotor assembly having vanes which divide the working cavity into a plurality of working chambers and which follow the position of the control ring to vary the volume of the working chambers so as to move fluid into and out of inlet and outlet ports, respectively. The vanes are supported by a plurality of concentric rings which are attached in gimbal fashion to a rotor hub and pin assembly.

As compared with other types of competitive devices, the hydraulic turbine of the present invention has the following advantages:

1. Smooth continuous transmission of speed ratios without any abrupt shifts or interruptions in power transfer;
2. No clutch, fluid coupling, or torque converters are required;
3. All gears are eliminated;
4. Much greater simplicity leading to higher reliability and lower cost;
5. Greater range of speed ratios from infinity-to-one to one-to-infinity;
6. No separate reverse is required;
7. No separate neutral or idle is required;
8. Can optionally provide for engine braking or free wheeling coast as desired;
9. Combines optimum speed ratios and high mechanical efficiency to result in a significant improvement in fuel economy (for automotive transmission applications);
10. The device is extremely flexible and easily instrumented to sense and control its various operational characteristics and thus lends itself to advanced methods of computer or microprocessor control;
11. Can be built in relatively small size and volume for high torque capacities thus making it possible to eliminate the conventional automotive transmission hump by packaging the entire transmission forward of the firewall;
12. As compared to other hydraulic drives, such as swash plate and piston type devices, the hydraulic turbine has greater drive smoothness and extremely close coupled, smooth, efficient flow in that the fluid flows in a continuous, near-circular path through large passages with a minimum of obstruction;
13. As compared to other vane type pumps, the hydraulic turbine design is more rugged and thus permits much greater torques and pressures to be realized. It also provides variable displacement, and moving parts are isolated from high hydraulic forces against rubbing surfaces, thereby resulting in reduced wear, high mechanical efficiency and long life; and
14. Simple self-actuated hydraulic control is possible using logic circuits to actuate change of speed ratio or desired mechanical behavior.

Other objects and advantages of the present invention will no doubt become apparent to those of ordinary skill in the art after having read the following detailed description of the preferred embodiment which is illustrated in the several figures of the drawing.

IN THE DRAWING

DETAILED DESCRIPTION OF THE PREFERRED EMBODIMENT

Figure 1:
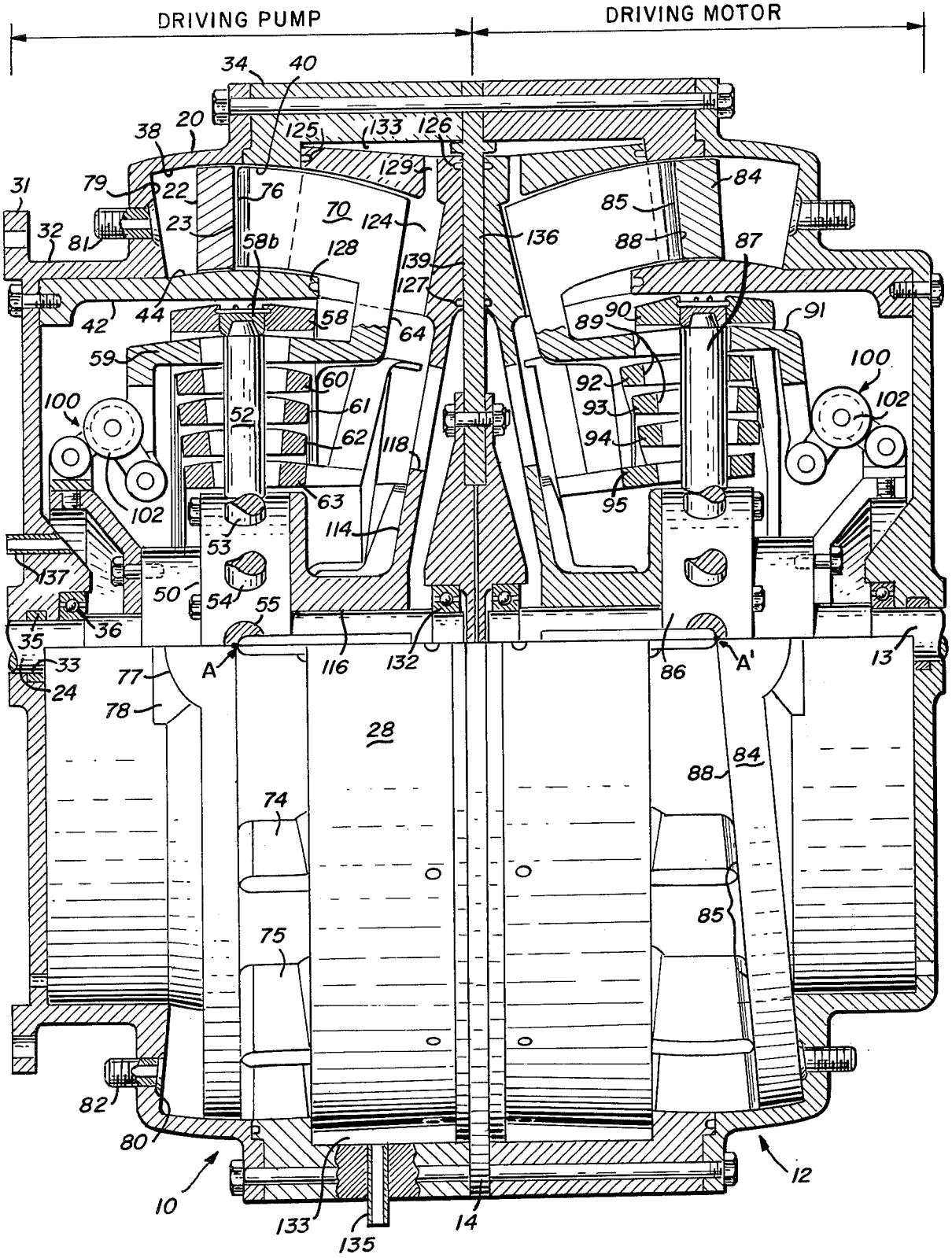
FIG. 1 is a partially broken axial section taken through a hydraulic transmission utlizing a pair of hydraulic turbines in accordance with the present invention.

The present invention relates to a hydraulic turbine which is suitable for use as both a pump and a driven motor. For purposes of illustration a power transmission apparatus embodying a pair of hydraulic turbines in accordance with the present invention is shown in FIG. 1. In this figure, the leftmost half represents the driving pump turbine 10 while the rightmost half of the figure represents the driven motor turbine 12. Both the pump and motor are identical in configuration, and either half of the device is capable of driving the other. The two turbines are separated by a divider plate 14 which has a pair or semiannular parts 16 and 18 (see FIG. 2) which allow fluid to pass from the driver pump to the driven motor and return in a continuous path. Although the embodiment illustrated is considered to be the most efficient coupling of the two units, it will be appreciated that it is also possible to drive two or more motors from the same pump. However, any physical separation of the pump and motor will reduce efficiency due to fluid flow losses.

Both the pump and the motor are variable displacement devices and are of the positive displacement type, and torque or speed can be multiplied by adjusting the displacement of the respective turbine units such that more or less shaft rotation is required to displace a given volume of fluid.

In FIG. 1, the top portion of the drawing is an axially cut-away section of the device while the bottom half of the drawing is a representation of the internal parts as seen with the outermost housing removed. In order to facilitate understanding of the various components of the apparatus, reference will also be made to the exploded illustration of the pump portion shown in FIG. 2, as well as to individual detail drawings shown in other figures.

Figures 2, 6:
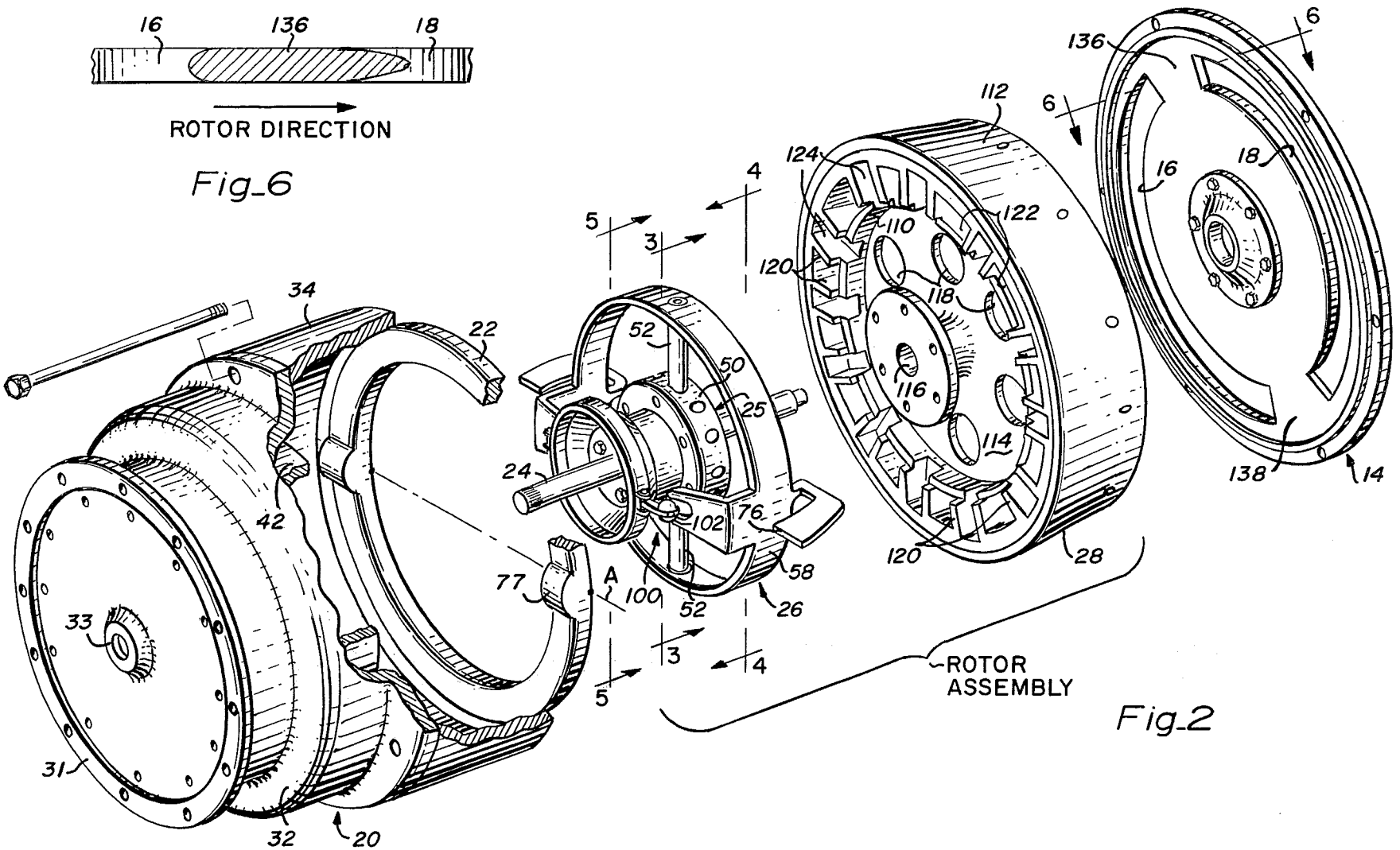
FIG. 2 is a partially broken exploded perspective view of the turbine forming the pump portion of the hydraulic transmission illustrated in FIG. 1.
FIG. 6 is a partial cross section taken along the line 6—6 of FIG. 2.

Referring now particularly to FIGS. 1 and 2, it will be seen that each hydraulic turbine includes an outer housing 20, a control ring 22, a rotor assembly including a shaft 24, a hub and pin assembly 25, a gimballed vane drive assembly 26, and a vane housing 28. The two turbines are communicatively joined together by the divider plate 14. In the illustrated preferred embodiment, the outer housing 20 is comprised of an end bell portion 32 and an annular body portion 34. Bell 32 is provided with a mounting flange 31 and a central opening 33 for receiving the shaft 24. Suitable seal and bearing means are shown at 35 and 36, respectively.

The inner wall surfaces 38 and 40 of housing members 32 and 34 are spherically configured to mate with the outer periphery of control ring 22 and the outermost edges of the rotor vanes of assembly 26. Concentrically nested within end bell 32 is an annular member 42 having a portion 44 of its outer surface spherically configured to mate with the inner periphery of control ring 22 and the innermost edges of the vanes of assembly 26.

Figure 3:
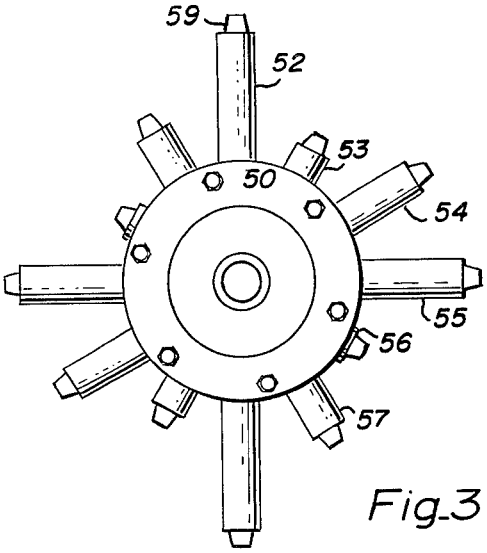
FIG. 3 illustrates the rotor hub and pin assembly more generally shown in FIGS. 1 and 2.

The assembly 25 includes a hub 50 which is attached to or is an integral part of the shaft 24, and attached to hub 50 are six pairs of pins 52–57 (see FIG. 3), each pair being of a different length as indicated. The outer ends of each pin are designed to accept a bearing of suitable design as indicated at 58*b* in FIG. 1. The bearing 58*b* must be capable of sustaining loads both perpendicular to the pins and axially relative thereto.

Figure 4:
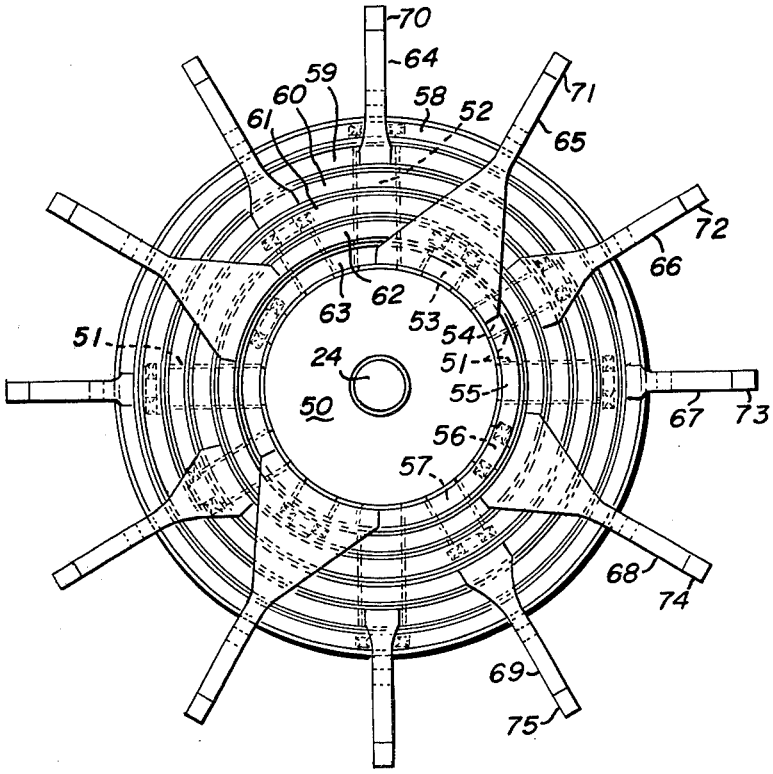
FIGS. 4 and 5 illustrate opposite sides of the vane driving portions of the rotor assembly more generally shown in FIGS. 1 and 2.

In FIG. 4 of the drawing, a rear end view of the vane drive assembly 26 is illustrated showing the rotor hub 50 and shaft 24, with the pins 52–57 depicted in phantom lines. The gimbal rings 58–63 are each attached by bearings to the ends of a pair of rotor pins and each gimbal ring is free to rotate a small amount about the axis of its associated pins. Note also that the rotor pins pierce the other gimbal rings as necessary through slotted holes 51 in the various rings. Each ring is thus free to rotate without obstruction from the hub 50, the other pins or other gimbal rings. Attached to each gimbal ring at points 90° removed from the pin attachment points are pairs of vane torque arms 64–69 which terminate in vanes 70–75 (see FIGS. 1 and 2). The vane design and its associated drive assembly is the heart of the hydraulic turbine device and acts somewhat like a universal joint assembly which permits each pair of vanes to rotate in a plane slightly different from the plane of rotation of the hub 50 and its attached pins.

The selection of twelve vanes is a design variable and alternatively, any even number of vanes greater than four could be used. The number of pins is equal to the number of vanes and the greater the number of vanes, the smoother the drive. The illustrated twelve-vane design has output pressure fluctuations of about plus or minus 1.5 percent at a frequency of 12 times per revolution with constant input torque and is smoother than most input sources of power.

The axial profile of the vanes 70–75 is as indicated in FIGS. 1 and 2, and consists of flat plates with spherically shaped inner and outer edges corresponding to the curvature of the housing surfaces 40 and 44. In the preferred embodiment, the vane tips 76 are tapered and rounded to form a contact seal with control ring 22. Alternately, the vane tips could be provided with pivotable contact elements having a broad contact surface so as to increase the wear life of the vanes. Note that the torque arms provide stand-off attachment of the vanes to the gimbal rings in order to avoid interference with the adjacent gimbal rings and the annular member 42.

The control ring 22 is merely an annular ring whose inner and outer circumferential surfaces are spherically shaped to mate with the housing surfaces 44 and 38 (FIG. 1), respectively. It forms a seal between these spherical surfaces so that fluid cannot escape from the chambers between the vanes. The control ring can rotate slightly about its axis A to control the plane of rotation of the vane edges 76 which make contact at all times at varying angles with the control ring 22. The contact surface 23 of the control ring 22 is flat and lies in a plane which is slightly offset from the center of the rotor hub 50 by an amount equal to the radius of the vane contact edge. The control ring 22 controls the plane of rotation of the vanes; such plane of rotation being rotatable relative to that of the plane of the rotor hub. This rotation is restricted to a single axis by means of a semicylindrically-shaped bearing segment 77 which divides the control ring into upper and lower annular portions. The cylindrical bearing segments mate with the ring seal 78 and are free to rotate thereagainst until the ring bumps into limit stops provided by the surfaces 79 and 80. The annular surfaces formed between surfaces 79 and 80, and control ring 22 contain fluid which is used to hydraulically actuate (rotate) the control ring as the fluid is pumped out of one chamber and into the other through passageways formed by conduits attached to nipples 81 and 82. Since the device itself is a hydraulic pump, it is possible to actuate the control ring by opening and closing bleed valves connected to the inlet and outlet of the hydraulic turbine itself as will be described below. This method eliminates the need for a separate actuator.

The function of control ring 22 is to vary the displacement of the pump or hydraulic motor. The direction of rotation of the control ring determines the direction of flow of fluid in the sense of which port in the divider plate 14 is the exit and which is the entrance for a given direction of shaft rotation. If control ring 22 is placed in the same plane as the rotor hub 50, there is zero displacement of fluid, and the pump idles without torque.

In the left-hand section of FIG. 1, the control ring 22 is shown in a vertical position whereby the centerline of the cylindrical vane tips will be caused to rotate exactly in the same plane as the rotor hub 50 and pins 52. In this position the gimbal rings 58–63 do not rotate at all with respect to their associated rotor pins. However, should control ring 22 be rotated about its axis A into a new position which is other than the vertical position, the gimbal rings will rotate about the axes of their associated rotor pins as the vane tips follow the surface of control ring 22.

The right-hand section of FIG. 1 shows the effect of rotating the control ring 84 about its axis A′ to its limit stop. The vane tips 85 will now rotate out of plane relative to the rotor hub 86 and pins 87 as they follow the surface 88 of control ring 84. Note how the slotted holes 89 in the gimbal rings 90–95 permit the required rotation of the gimbal rings without interference from the pins 87. Each gimbal ring rotates a different amount of its associated rotor pins to maintain contact between the vane edges 85 and the control ring surface 88.

It is important to recognize that the vane edges can never lose contact with the planar surface 88 because each vane has an opposing vane mate that is 180° away from it in the rotor assembly and the opposing vane mate also contacts the control ring surface. It is therefore impossible for the vanes to lose contact with the control ring surface or to float and break the seal because if one vane tries to float free of the surface, it transmits a force through the gimbal ring to the control ring, tending to force the opposing vane mate into the surface. This characteristic of the hydraulic turbine is definitely superior to any prior art vane pump designs.

Figure 5:
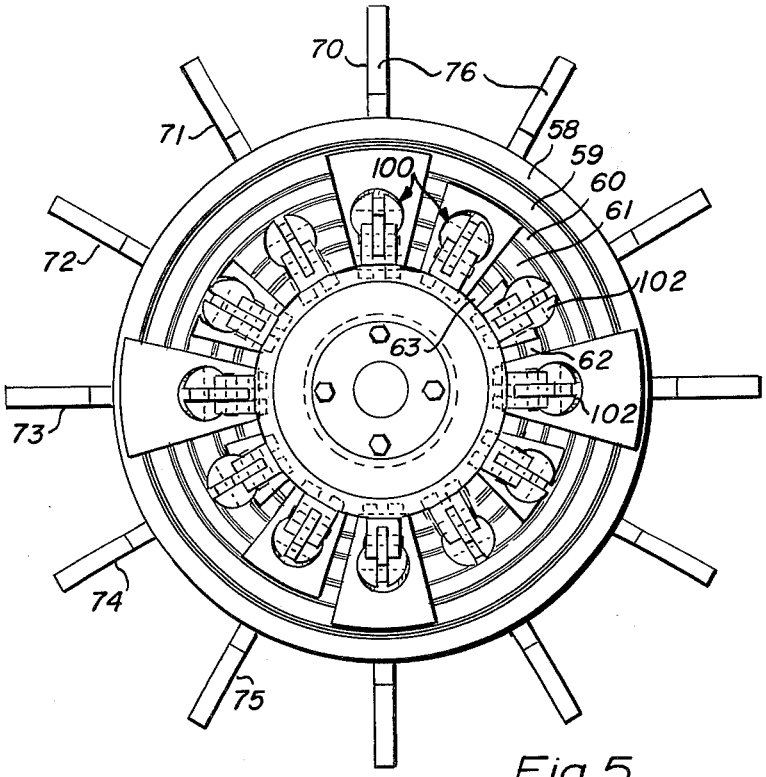

An analysis of the vane contact forces indicates that there is a small inertia force acting between vane edges and control ring surfaces which will tend to increase wear, even though the vane and gimbal ring assembly rotates freely out of plane with the rotor hub and pin structure. To alleviate this problem, inertial load compensation linkages 100 have been added which totally eliminate the loads on the vane tips at their contacting edges (see also FIG. 5). These linkages include counter balancing weights 102 which produce a restoring moment on the gimbal ring that is proportional to the square of the shaft speed and the gimbal ring displacement (tilt angle). At zero displacement relative to the vertical plane of rotation, the moment is zero while at any other gimbal ring displacement the moment is in the direction required to return the ring to zero displacement.

The size of the weights 102 is such that the "apparent" moment of inertia of the gimbal rings is counterbalanced by centrifugal forces. As used above, the "apparent" moment of inertia $I_a$ is defined as $$I_a = I_x + I_y - I_z .$$

Where $I_x$ is the polar moment of inertia of the gimbal ring about its rotor pin axis, $I_y$ is the polar moment of inertia about an axis in the plane of the ring normal to the pin axis, and $I_z$ is the polar moment of inertia of the gimbal ring about the axis of the shaft. Note that the effective weight of the weights must take into account buoyancy forces which exist in the fluid from the centrifugal field. The effective density of the weights is the density of the metal minus the density of the fluid. These linkages will significantly reduce wear at the vane edges. The linkages could be eliminated if size, rotational speed, and required life of the transmission do not result in excessive vane edge wear. In addition, the alternative vane tip constructions previously mentioned could be used to extend the vane wear life and thus eliminate the need for the balancing linkages.

Referring now to FIGS. 1 and 2, it will be noted that the rotor vane housing 28 is a solid structural part of the rotor assembly and that it is attached to the hub 50 and rotates with the rotor shaft. The vane housing may be thought of as consisting of specially shaped inner and outer rings 110 and 112, respectively, the inner ring being connected to hub 50 by a solid inner body part 114 containing holes 116 for the center shaft 24 and 118 which provide vent holes. The inner ring is connected to the outer ring by slotted vane sleeves 120 which project radially outward from the inner ring to the outer ring in spoke-like fashion and leave axially directed fluid passages 122 therebetween. When affixed to the hub 50, the vanes extend into slots 124 in the sleeves 120 and are free to slide in the axial direction.

The vane housing 28 is not intended to be a torque transmitting member, and contact with the vanes is for sealing purposes only. Adequate tolerances in the slots are provided so that slight vane deflections under load do not cause material contact pressure in the slots even though a spring-loaded or other type of seal may be provided to seal the vane within the slot. Note that seals 125, 126 and 127 are provided in vane housing 28 at the points of contact with housing 34, and divider plate 14, and that a seal 128 is provided in housing 42 so that fluid contained within the twelve passages 122 must rotate with the rotor assembly but is free to pass into and out of the rotating assembly via the passages.

Positioning of the four rotary seals as indicated also permits hydrostatic load balancing of the rotor to the extent that all forces are balanced and all moments perpendicular to the shaft are balanced at maximum displacement or "cruise" conditions. At cruise then, there are no loads on the rotor assembly other than a pure couple equal to the input or output torque. No net forces are present at any time, but the moment perpendicular to the shaft will be non-zero at other than maximum displacement or "design" displacement. This moment is efficiently supported with minimal friction by the shaft bearings 36 and 132.

Divider 14 serves as a mount for the shaft end bearings 132, provides inlet and outlet ports 16 and 18, and sealing surfaces 136 and 138 separating the inlet and outlet flow from the pump (see FIG. 2).

Fluid within the pump rotates in a plane parallel to the control ring 22 and enters and exits through the semiannular port sections 16 and 18. The only stationary obstructions to flow are the airfoil-shaped sealing segments 136 and 138 (see also FIG. 6) which separate the inlet and outlet ports and provide a sealed contact area that communicates with the back edge 139 of the vane sleeves in the vane housing (see FIG. 1). Inlet and outlet pressures are thus separated by a single vane pair and associated sleeves since only a single pair of sleeves are in contact at any one time with the sealing segments of the divider plate.

The vane housing 28 serves the following functions: it provides a seal with the vanes in the slots to confine fluid in each of 12 fluid passageways; it provides inner and outer rotary seals at the vane housing's inner- and outer-shaped rings; it provides smooth-shaped passages for fluid to pass into and out of the pump; and it provides a solid structural member which supports internal hydraulic pressures without transmitting high hydraulic loads to the rotary shaft. Output pressure is confined between the inner and outer rings 110 and 112, and adjacent pairs of vane sleeves 120. Stresses are thus generally internal of the vane housing and are not felt by the shaft. The force resulting from the axially displaced positions of seals 125 and 128 counterbalances the force on the net projected vane area, the moment of which is counterbalanced at design displacement by the axial projected area resulting from the radial displacement of seals 126 and 127. Similarly, hydraulic loads are not transmitted to the rotating sealing surfaces around the vane housing.

The vane housing is vented through the vane sleeve slots and ports 129 and the vent holes 118 in the inner body to allow leaking high pressure fluid to escape without producing a net load on the shaft or seals. These vents are also useful for filling the pump with fluid and allowing it to pass to the inner shaft bearing 132. It will also be appreciated that centrifugal forces acting on the fluid surrounding the rotor assembly will cause the fluid pressure in the annular chamber 133 to exceed the pressure of the fluid in the vicinity of shaft 24. This pressure differential can be used to advantage to cool the device by connecting appropriate cooling plumbing between the outlet nipple 135 and the return nipple 137. In addition, the centrifugal pressure could be used by control logic to sense the driver and driven shaft speeds. This would be useful if hydraulic "logic" were to be used instead of the more preferred digital computer logic.

In operation, fluid confined between the vanes and their sleeves in the vane housing must rotate with the entire rotor assembly. The fluid in the chambers defined by the vanes, their sleeves in the vane housing, the control ring surface and the spherical housing surfaces 38 and 44 cannot enter or leave the chambers except through the passages 122 which communicate with the entrance and exit ports 16 and 18 of the divider plate 14. When the control ring 22 is placed in a different plane than that of the rotor, as in the motor portion shown at the right in FIG. 1, the fluid chambers increase and decrease in volume as the rotor rotates. The divider plate insures that the chambers which are decreasing in volume are connected to the exit port and chambers increasing in volume are connected to the entrance port. In the hydraulic turbine transmission application depicted in FIG. 1, fluid which exits the driver pump after the control ring 22 is tilted from the vertical position enters directly into the driven motor and forces it to rotate to accommodate the volume of fluid displaced by the driver. And as it rotates, the driven turbine itself exits the fluid and returns it to the driver in a continuous flow.

An analysis of the device indicates that torque is transmitted directly from only one pair of vanes in the driver turbine to another pair in the driven turbine, and such torque is altered as desired by setting the control ring of the driver and driven turbines so as to expose different net areas of each vane pair. The vane pairs are under load only as they pass by the solid sealing segments 136 and 138 between the entrance and exit ports of divider plate 14. At other times, the pressure on opposite sides of the vanes is always equal. Torque in the driven turbine is directly proportional to the difference between inlet and outlet pressures and the net difference in exposed vane area outside of the vane housing for the active vane pair. This torque is transmitted from the vanes through the gimbal rings to the rotor hub and output shaft 13.

A thrust load parallel to the active rotor pins is present which is proportional to the pressure difference and the total vane area exposed. This is the only force on the gimbal ring which is nonproductive of torque. It is counterbalanced by an opposite force on the vane housing resulting from a net area of the outer ring 112 greater than the inner ring 110. Use of efficient bearings on the rotor pins will insure a high mechanical efficiency. The gimbal bearings 58 carry this load but are almost motionless while under load (only 3 percent of travel in a 12-vane design).

Since both the driver and driven turbines of the transmission feature variable and reversible displacement, almost any conceivable operation characteristics or capabilities are possible with suitable external control logic, the device can be caused to position its output shaft 13 at any desired position, lock it in place, or follow a prescribed motion as a function of time. It can also cause the input or output to coast without load. The implementation of control logic is a development detail which depends to a high degree on the specific application desired. Certain general considerations are worthy of mention here, however, since they have general application and should be recognized when designing a control system for the transmission.

The control of the transmission is completely defined by the control of the input and output control rings 22 and 84, respectively. Depending on the specific application, the input or output pump can be made to have a fixed displacement by replacing the control ring by a fixed surface. This is a desirable simplification if it meets the operational requirements of the specific application. As mentioned previously, these rings are hydraulically actuated by pumping fluid into and out of the chambers defined by the upper and lower portions of the control rings, the ring seals and the surrounding stationary housing. The most convenient method of providing hydraulic control is to make direct use of the input and output pressures of the transmission pumps. This avoids external actuators and provides valuable hydraulic logic inputs which sense the operating characteristics of the transmission. In general, the inputs to the external control logic are sense and magnitude of input and output pressure, the direction of rotation, and rotational speed of the input and output shafts. These inputs are readily available. Note specifically that knowledge of the actual positions of the control rings is generally not required, since it can be implied from other inputs. In a preferred embodiment the control system is envisioned as consisting of electronic switching logic which acts on the inputs provided by the device and changes the operating characteristics of the transmission as desired by opening and closing valves which effect control ring position or internal hydraulic logic. This concept is readily adapted to computer or microprocessor control and unprecedented performance and operation efficiency are possible by optimization of the driver and transmission characteristics with the output load requirements.

Consider now the factors which must be recognized with regard to the operation of the control rings of the hydraulic turbines of both the driver and driven sides of the transmission device. First, the range of tilt of the control rings is defined by the mechanical limit stops provided to restrain the control ring in its operational range while input and output shafts are at rest and no control hydraulic pressure is available. The control ring must additionally be provided with an active hydraulic limit stop to prevent driving it to the mechanical stops and possibly damaging the control ring or rotor vanes.

Secondly, since the control ring bearing segment restrains the ring on only one side, it is highly desirable to maintain a positive hydraulic seating force which forces the control ring bearing segments against the ring seals. While it is true that the ring is restrained in the other direction by the spherical housing and the rotor vanes, the ring could jam on the spherical housing or place excessive loads on the vane tips, and high hydraulic forces could damage the ring, the housing or the vanes. Furthermore, loads on the vane tips would produce excessive friction and wear. The alternative to positive control of the hydraulic seating pressure on the ring seal is to further mechanically constrain the control ring with externally mounted bearings and pivot arms. However, such added mechanical complexity does not appear to be justified.

Positive control of the ring seal force also helps minimize leakage between the upper and lower control chambers. Note that there is a natural tendency for the pump to produce a seating force on the control ring since half of the ring is always exposed to high pump outlet pressure on the vane contact side of the ring. Ring seal seating can be assured by controlling the pressures on the opposite side to something between low inlet and high outlet pump pressure. This can be accomplished by pressure regulation and venting of the control ring chambers through pressure relief valves. The maximum allowable control pressure in the ring control chamber is determined by an analysis of forces on the ring. The low pressure side of the ring will always unseat first. The difference between the maximum allowable control pressure and the low pump pressure is proportional to the difference in the high and low pump pressures. The positive ring seal pressure constraint can be satisfied by means providing proportional regulation of control pressure and by proportional control chamber relief valves. Control valves of this type are easily constructed. Other types of control valves required are source selection valves which determine which side of the pump is high pressure and which is low, and conventional on/off devices.

Figure 7:
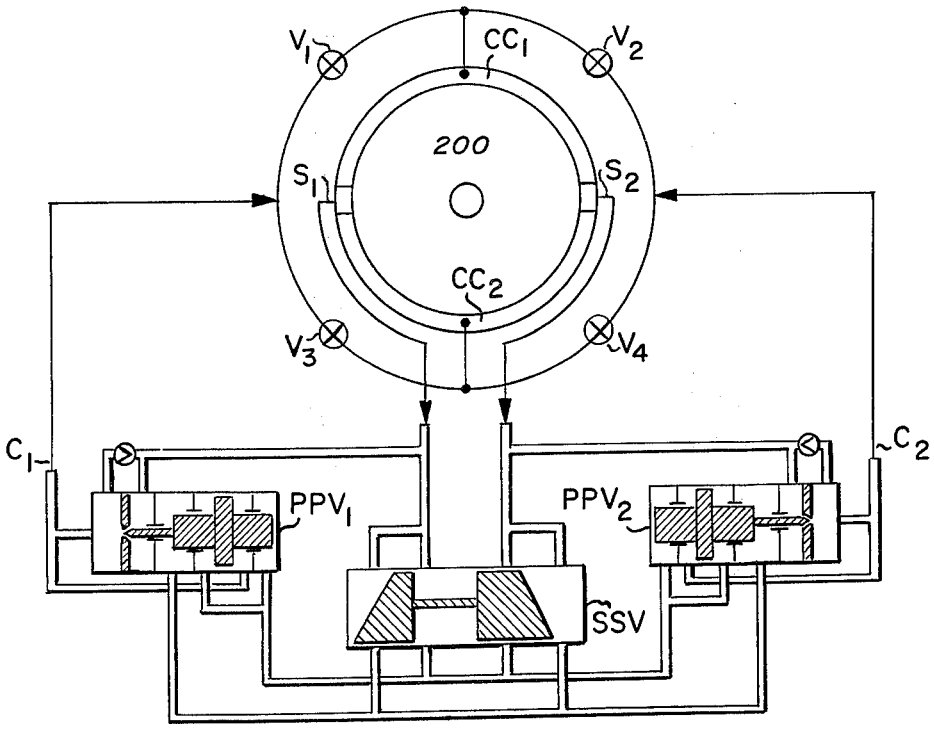
FIG. 7 is a diagram schematically illustrating hydraulic control valving which may be used in accordance with the present invention.

One such regulation network is illustrated in FIG. 7 and includes a source selection valve (SSV) and a pair of pressure proportioning valves ($PPV_1$ and $PPV_2$). Valve SSV determines which of the pressure sources $S_1$ or $S_2$ from turbine 200 is the low pressure source and which is the high pressure source, and causes valves $PPV_1$ and $PPV_2$ to regulate the control pressures C supplied to valves $V_1$ and $V_3$, and $V_2$ and $V_4$, respectively. The valves PPV operate such that if the source pressure S applied thereto is the higher of the two source pressures, then the control pressure C will be greater than the low source pressure but less than the high source pressure and less than required to unseat the control ring. On the other hand, if the applied source pressure S is equal to the lower of the two source pressures, then the control pressure C will be equal to the lower pressure.

Assuming that all of the above considerations are understood, it is now instructive to consider the types of hydraulically switched connections which produce the normally required control commands to the transmission. Consider, for example, that the transmission is to be used in an automobile. The normally required control commands are as follows:

1. Place the engine (driver) in neutral or "free-wheeling" condition.
2. Place the output in a "free-wheeling" coast condition.
3. Cause the engine to brake the output.
4. Place the output in forward or reverse drive relative to the engine rotation.
5. Advance the output speed ratio.
6. Retard the output speed ratio.

As indicated in FIG. 7, there are only two possible connections of the pump inlet and outlet pressures $S_1$ and $S_2$ to the two control chambers $CC_1$ and $CC_2$. When referring to high pressure, the reference is to regulated high control pressure so as not to unseat the control ring. Since in the transmission there are in effect two pumps i.e., the input (driver) and the output (receiver), there are four possible combinations of connections which can exist simultaneously. Each connection can be regarded as a command to the control ring but the meaning of the command can in general depend upon the direction of rotation, the present direction of control ring tilt and which shaft is presently driving the other. The problem is determined by specifying the principal driver or input shaft of the transmission, its direction of rotation and the preferred direction of tilt from which the input pump is to engage the output pump. The ambiguity about whether the input is driving the output or the output is driving the input, i.e., engine braking, can be removed by a source selection valve which identifies which side of the transmission has highest pressure. In the case of free-wheeling or neutral, the transmission can be commanded to think for itself in order to drive the difference in pressure to zero which is synonymous with zero torque transfer.

The problem is best understood by defining the rules of control which define the effects of possible hydraulic connections. Again, there are only two connections for each control ring but the connections have different effects depending upon whether the associated turbine is the active driver or receiver of torque transmission, and upon the direction of shaft rotation. In the following rules of control, the active driver turbine is the pump whose exit flow is at the highest pressure; the active receiver turbine is the pump whose entrance flow is at the highest pressure; and the control plane is the plane containing the axis of the rotor shaft and the axis of rotation of the control ring. The control ring hydraulic control chambers are on opposite sides of the control plane and the rotor vanes pass through the control plane on each side of the pump as the rotor revolves.

The four rules of control can now be stated as follows:

1. If a pump is the active driver and both source pressures existing at the control plane are connected to the control chambers on the sides of the plane opposite to the direction of motion of the vanes, the control ring will be driven to a point of stable equilibrium causing the driver to free-wheel without resistance to motion and no torque will be transmitted to the receiver turbine. The condition of stable equilibrium will continue as long as the driver is not required to exceed its maximum displacement to match the receiver pump flow. If this occurs, the receiver will assume the role of the driver. While the control ring is in transit, this same connection of sources can allow the driver to speed up to any desired speed ratio relative to the receiver shaft.
2. If a pump is the active driver and both source pressures existing at the control plane are connected to the control chambers on the sides of the plane toward the direction of motion of the vanes. The control ring will be driven away from a point of unstable equilibrium corresponding to zero displacement until reaching maximum displacement. This connection will cause the driver to assume a load and to advance the speed of the output shaft relative to the input shaft up to maximum driver displacement.
3. If a pump is the active receiver and both source pressures existing at the control plane are connected to the control chambers on the sides of the plane opposite to the direction of motion of the driver vanes, the receiver control ring will be driven toward its maximum displacement in a direction which will cause the receiver to rotate in the same direction as the driver. While in transit from zero displacement the output speed ratio will decrease; in transit from the opposite limit, the speed ratio will increase in reverse direction,
4. If a pump is the active receiver and both source pressures existing at the control plane are connected to the control chambers on the sides of the plane towards the direction of rotation of the driver vanes, the receiver control ring will be driven toward its maximum displacement in a direction which will cause the receiver to rotate in the reverse direction from the driver. While in transit from zero displacement the output speed ratio will decrease; in transit from the opposite limit, the speed ratio will increase in the forward direction.

The four rules of control can be used to command any of the aforementioned requirements of an automobile transmission. All that is required is the capability of making any of the desired hydraulic connections at will by opening or closing command control valves either continuously or momentarily. The valves could be under authority of a command control unit with a microprocessor or minicomputer control logic program.

Figure 8:
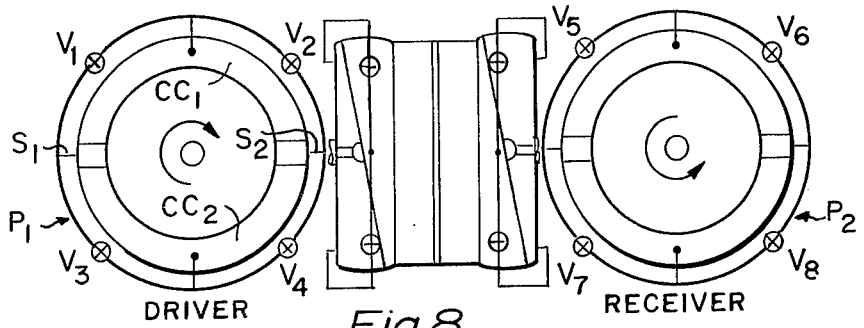
FIGS. 8–12 are schematic diagrams illustrating operation of the embodiment shown in FIG. 1.
Figure 9:
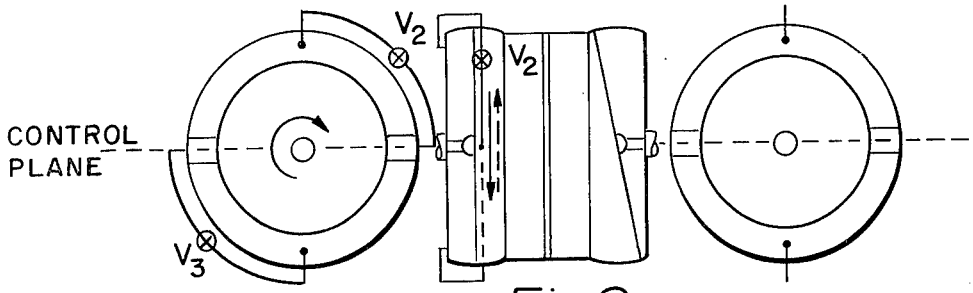
Figure 10:
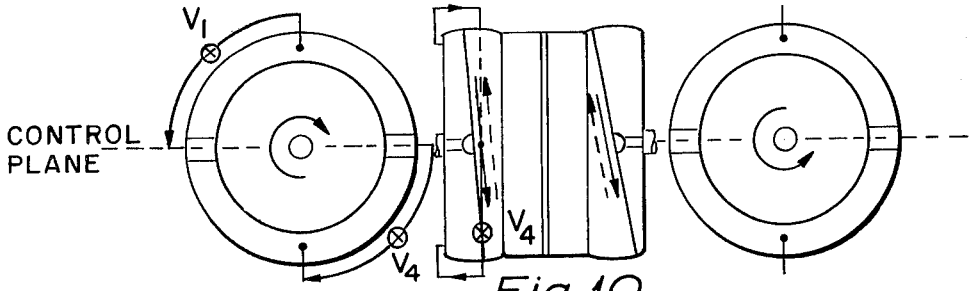
Figure 11:
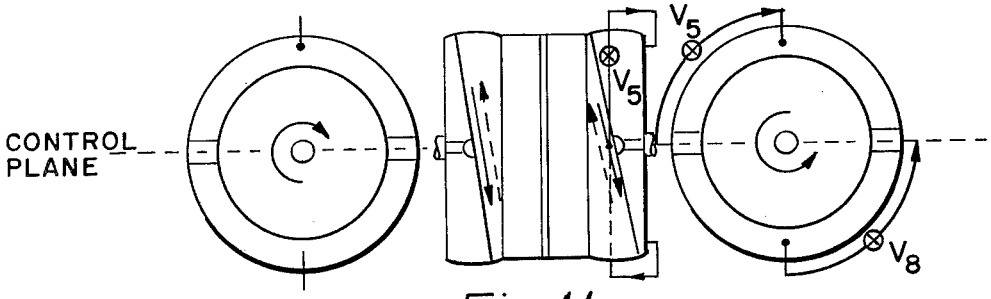
Figure 12:
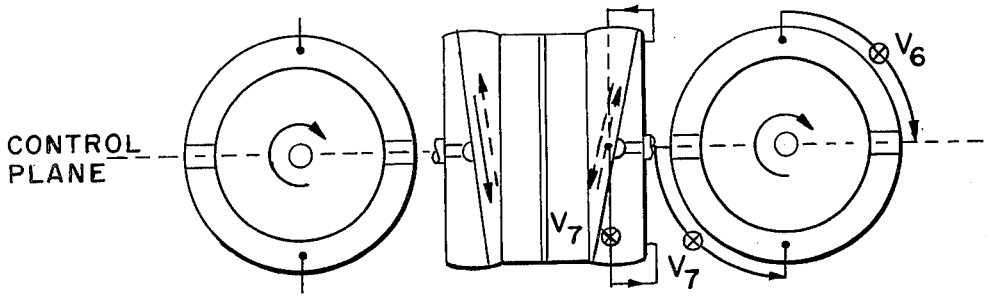

In FIG. 8 a transmission in accordance with the present invention is schematically illustrated with four driver control valves $V_1$-$V_4$ and four receiver control valves $V_5$-$V_8$. FIGS. 9 through 12 respectively illustrate the valve commands stated in Table I which are necessary to cause the transmission to operate in accordance with the four previously stated rules of control.

In applying the receiver rules 3 and 4, it should be understood that these rules are written in the driver frame of reference. When studying the rules, it will be appreciated that the ultimate direction of rotation of the receivers is determined by the two possible source connections and is independent of the direction of driver rotation or tilt of the driver control ring. An important application of this fact is that in an automotive application, the engine may be push-started in the proper direction of rotation by pushing the car either forward or reverse with the normal output control ring tilted in either direction from vertical. When the engine starts, it will assume the role of driver and will be connected in the neutral configuration and incapable of assuming any load.

TABLE I

| Rule No. | Command | Valve Commands |
|---|---|---|
| 1 (See Fig. 9) | Driver to neutral or free wheeling condition, or in transit advance driver speed. | Open $V_2$ & $V_3$; Close $V_1$ & $V_4$ |
| 2 (See Fig. 10) | Driver to assume load, reduce driver speed, or advance output speed. | Open $V_1$ & $V_4$; Close $V_2$ & $V_3$ |
| 3 (See Fig. 11) | Receiver to accept output load in the forward direction, or in transit reduce output speed. | Open $V_5$ & $V_8$; Close $V_6$ & $V_7$ |
| 4 | Receiver to accept output load in the reverse direction, or in | Open $V_6$ & $V_7$; Close $V_5$ & $V_8$ |

TABLE I-continued

| Rule No. | Command | Valve Commands |
|---|---|---|
| (See Fig. 12) | transit increase output speed. | |

When considering self-actuation, one minor problem results from Rule 2 in that a position of unstable equilibrium exists for the driver turbine at zero displacement. The control ring cannot theoretically be removed from a zero displacement position, but only a slight disturbance will cause it to go either way. While the final outcome of the receiver pump connections is the same independent of the direction of driver pump tilt, undesirable transients can occur. What is required is a preferred direction of tilt for the driver and consequently the receiver also. This can be accomplished by a small spring bias on the driver control ring in the preferred direction when near zero displacement and will result in an almost imperceptible torque on the output when the driver is in neutral. This small torque is not a problem in automotive applications and allows a control pressure to be present to place the receiver in forward or reverse drive while the driver is in neutral. Alternatively, the output can be fixed displacement, and forward and reverse will be determined by positive control of the driver control ring tilt. In this configuration the spring bias method is not applicable.

Alternatively, centrifugally generated fluid pressure available at nipple 135 (FIG. 1) could also be used to activate the control ring. This source is available from the driver even when the transmission is in the neutral configuration and therefore avoids any need for a spring to initiate motion of the ring from idle. Source selection valves can be used to choose which pressure source is at the highest pressure.

The above discussions on self-actuation are presented to demonstrate that it is feasbile and has the advantages that neutral or free-wheeling are directly commandable control connections and that separate hydraulic control pumps are not required. The transmission itself is not inherently restricted to the limitations of self-actuation and can be independently actuated or both methods of control can be combined.

Although the present invention has been described above with reference to a particular preferred embodiment, it is contemplated that many alterations and modifications will become apparent to those skilled in the art after having read this disclosure. It is therefore intended that the appended claims be interpreted as covering all such alterations and modifications as fall within the true spirit and scope of the invention.

What is claimed is:

1. A hydraulic pump comprising:

a housing having first and second facing, spherically surfaced, concentric wall portions cooperating with an end wall portion to form an annular cavity;

a divider plate affixed to one end of said housing and having fluid inlet and outlet ports therein disposed in spaced apart facing relationship with said end wall portion;

an annular control ring disposed within said cavity and mounted to rotate therewithin about a diameter thereof which passes through the geometrical center point of said concentric wall portions, one side of said control ring cooperating with said end wall portion and parts of said first and second wall portions to form at least one hydraulic ring control chamber, and another side of said control ring cooperating with other parts of said first and second wall portions to form a hydraulic working chamber;

an elongated shaft extending into said housing with its axis passing through said center point;

a rotor assembly affixed to said shaft and including an annular vane housing sealingly sandwiched between the portions of said housing forming said cavity and said divider plate, said vane housing being affixed to said shaft, and having a plurality of openings disposed around an annular segment thereof for communicatively coupling said cavity with said inlet and outlet ports, said vane housing further having a plurality of vane sleeves disposed between said openings, a hub and pin assembly affixed to said shaft and including a plurality of elongated pins extending radially outwardly from said shaft with their center lines disposed in a plane normal to the axis of said shaft at said center point, a plurality of concentric gimbal rings disposed about said shaft with each such ring being pivotally attached to a pair of said pins, a plurality of vanes attached to various ones of said gimbal rings, said vanes each being disposed within one of said sleeves and extending through said working chamber into engagement with said other side of said control ring to divide said working chamber into subchambers, whereby the positioning of said control ring at other than normal to said shaft causes the volumetric dimensions of said subchambers to vary as said rotor assembly revolves.

2. A hydraulic pump as recited in claim 1 wherein said rotor assembly further includes a centrifically actuated linkage means coupling said shaft to said gimbal rings to provide inertia load compensation therefor.

3. A hydraulic pump as recited in claim 1 and including a second hydraulic ring control chamber, said pump further comprising fluid conduit and valve means for selectively coupling relatively high pressure fluid from said working chamber to one of said ring control chambers and for selectively coupling relatively low pressure fluid from said working chamber to the other of said ring control chambers.

4. A hydraulic turbine as recited in claim 3 wherein said valve means includes a source selecting valve and at least one pressure proportioning valve, said valves being operative to regulate the control pressures applied to said ring control chambers so as to prevent said control ring from being unseated by the application of control pressures.

5. A pump means comprising:

a housing including, a first means having an annular outer surface that is spherically configured, and a second means having an annular inner surface that is spherically configured and disposed concentric with said outer surface to form an annular cavity therebetween, said housing further including third means closing one side of said cavity, and means having an inlet port and an outlet port disposed in spaced apart facing relationship with the other side of said cavity;

an annular control ring disposed within said cavity and pivotally connected to said housing so as to be pivotable about a first axis passing through the geometrical center point of said cavity, said control ring being operative to divide said cavity into a first control ring actuating chamber, a second control ring actuating chamber and a working chamber; and a rotor means comprising, an elongated shaft having an axis of rotation passing through said center point, a rotatable vane housing attached to said shaft and having a front face facing said working chamber and sealingly engaging said first means and said second means, a back face sealingly engaging said third means on each side of said inlet port and said outlet port, a plurality of openings passing through said vane housing for communicating said working chamber with said inlet and outlet ports, and a plurality of vane sleeves disposed between adjacent ones of said openings, and a plurality of vanes and gimbal means for attaching said vanes to said shaft, said vanes each being received within one of said sleeves and having an extremity thereof extending out of said sleeve into said working chamber and into contact with said control ring, said vanes being operative to divide said working chamber into subchambers which increase and decrease in volume when said control ring is in any disposition other then normal to the axis of said shaft and said rotor means rotates with said shaft.

6. A pump means as recited in claim 5 wherein said gimbal means includes a plurality of pins attached to said shaft and extending radially outwardly therefrom, and a plurality of concentric gimbal rings each of which is pivotally attached to a pair of oppositely extending ones of said pins and is rotatable about the axis of the respective pair of pins, each of said vanes being attached to one of said concentric rings by an offset arc at a point rotated 90° relative to the pin attachment points.

7. A pump means as recited in claim 6 wherein said rotor means further includes a centrifically actuated linkage means coupling said shaft to said gimbel rings to provide inertia load compensation therefor.

8. A pump means as recited in claim 5 and further comprising, fluid conduit and valve means for selectively coupling relatively high pressure fluid from said working chamber to one of said first and second actuating chambers and for selectively coupling relatively low pressure fluid from said working chamber to the other of said first and second actuating chambers.

9. A pump means as recited in claim 8 wherein said valve means includes a source selecting valve and at least one pressure proportioning valve, said valves being operative to regulate the control pressures applied to said first and second chambers so as to prevent said control ring from being unseated by the application of control pressures.

10. A pump means as recited in claim 5 wherein said inlet and outlet ports are elongated slots, each extending along circular paths aligned with said openings in said vane housing, and each subtending an arc of less than 180°.

11. A hydraulic transmission apparatus comprising:

a driving pump section including a first housing including a first means having a first annular outer surface that is spherically configured, and a second means having a second annular inner surface that is spherically configured and disposed concentric with said first outer surface to form a first annular cavity, said first housing further including third means closing one side of said first cavity, and divider plate means having an inlet port and an outlet port disposed in spaced apart facing relationship to the other side of said first cavity;

a first annular control ring disposed within said cavity and operative to pivot about a first axis passing through the geometrical center point of said first cavity, said first control ring being operative to divide said first cavity into first control ring actuating chambers and a first working chamber;

a rotor means including an elongated input shaft, a first rotatable vane housing attached to said input shaft and having a first front face facing said first working chamber and sealingly engaging said third means on each side of said inlet port and said outlet port, a first plurality of vane sleeves radially disposed about the center of said first vane housing, and a plurality of first openings passing through said first vane housing for communicating said first working chamber with said inlet and outlet ports, and a plurality of first vanes and first gimbal means for attaching said first vanes to said input shaft, said first vanes each being received within one of said first sleeves and having an extremity thereof extending out of the associated sleeve, into said first working chamber, and into contact with said first control ring means, said first vanes being operative to divide said first working chamber into first subchambers which increase and decrease in volume when said first control ring means is in any disposition other than normal to the axis about which said input shaft and said rotor means, rotate; and a driven pump section coupled to said driving pump section and operative to receive fluid from said outlet port and be driven thereby, and then return said fluid to said inlet port.

12. A hydraulic turbine transmission apparatus as recited in claim 11 wherein said driven pump section includes:

a second housing affixed to said first housing and including a fourth means having a second annular outer surface that is spherically configured, fifth means having a second annular inner surface that is spherically configured and disposed concentric with said second outer surface to form a second annular cavity, and sixth means closing one side of said second cavity;

a second annular control ring disposed within said second cavity and operative to pivot about a second axis passing through the geometrical center point of said second cavity, said second control ring being operative to divide said second cavity into second control ring actuating chambers, and a second working chamber; and a second rotor means including an elongated output shaft sharing a common axis with said input shaft, a second rotatable vane housing attached to said output shaft and having a second front face facing said second working chamber and sealingly engaging said fourth means and said fifth means, a second back face sealingly engaging the opposite side of said divider plate means on each side of said inlet port and said outlet port, a plurality of second vane sleeves radially disposed about the center of said second vane housing, and a plurality of second openings passing through said second vane housing for communicating said second working chamber with said inlet and outlet ports, and a plurality of second vanes and second gimbal means for attaching said second vanes to said output shaft, said second vanes each being received within one of said second sleeves and having an extremity thereof extending out of said second sleeve, into said working chamber, and into contact with said second control ring, said second vanes being operative to divide said second working chamber into second subchambers which increase and decrease in volume when said second control ring means is in any disposition other than normal to the axis about which said output shaft and said second rotor means rotate.

* * * * *